US012426722B2

(12) United States Patent
Yen

(10) Patent No.: US 12,426,722 B2
(45) Date of Patent: Sep. 30, 2025

(54) BABY CARRIER

(71) Applicant: James K. C. Yen, Taipei (TW)

(72) Inventor: James K. C. Yen, Taipei (TW)

( * ) Notice: Subject to any disclaimer, the term of this patent is extended or adjusted under 35 U.S.C. 154(b) by 145 days.

(21) Appl. No.: 18/512,027

(22) Filed: Nov. 17, 2023

(65) Prior Publication Data

US 2025/0160538 A1 May 22, 2025

(51) Int. Cl.
*A47D 13/02* (2006.01)

(52) U.S. Cl.
CPC ..... *A47D 13/025* (2013.01)

(58) Field of Classification Search
CPC ..... A47D 13/025; A45F 3/14
USPC ..... 224/642, 623, 158–161
See application file for complete search history.

(56) References Cited

U.S. PATENT DOCUMENTS 5,361,955 A * 11/1994 Gregory ..... A45F 3/047 224/907
9,521,912 B2 * 12/2016 Yen ..... A47D 13/025
2010/0102097 A1 * 4/2010 Lundh ..... A47D 13/025 224/160

FOREIGN PATENT DOCUMENTS

EP 1452155 A2 * 9/2004 ..... A61F 5/028

* cited by examiner

*Primary Examiner* — Nathan J Newhouse
*Assistant Examiner* — Matthew T Theis
(74) *Attorney, Agent, or Firm* — LANWAY IPR SERVICES; Chun-Ming Shih

(57) ABSTRACT

A baby carrier having a front carrier, a rear neck pad, and a spine support pad is provided. A lower edge of the front carrier is connected with a front waist strap. A left waist strap and a right waist strap are respectively extending from left and right sides of the front waist strap. A lower edge of the spine support pad abuts against lumbar spine to lighten loads of the lumbar spine and spine. A plurality of pressure relief blocks is disposed on an inner surface of the spine support pad for reducing sultry feeling. The front carrier, the left waist strap, the right waist strap, and the spine support pad are connected by a left band and a right band whose length are adjustable. Thereby the baby carrier easy to put on and off allows users to move their arms freely and have comfortable wearing experience.

7 Claims, 8 Drawing Sheets

BABY CARRIER

FIELD OF THE INVENTION

The present invention relates to a baby product, especially to a baby carrier which is easy to put on and off, having ergonomic design, and providing breathable and comfortable wearing experience.

BACKGROUND OF THE INVENTION

Refer to U.S. Pat. No. 9,521,912 B2 applied by the same inventor of the present invention, an infant carrier is provided. The infant carrier contains a front carrying bag, a neck support pad, and an auxiliary support cushion. The auxiliary support cushion is used for supporting a carrier's back above carrier's lumbar and corresponding to the carrier's vertebra. Two sides of an upper end of the front carrying bag are provided with a first carrying strap and a second carrying strap whose rear end are connected with the neck support pad. A bottom rim of the neck support pad is provided with an adjustable belt connected with an upper rim of the auxiliary support cushion. The front carrying bag also includes a first waist strap and a second waist strap which are fixed on two sides of the front carrying bag and coupled with two sides of the auxiliary support cushion. About a middle section of the two sides of the front carrying bag is coupled with a first fixing strap and a second fixing strap. The first fixing strap and the second fixing strap are adjustable and joined with two sides of the neck support pad such that the neck support pad is pulled tightly to contact with the carrier's neck.

The neck support pad provides the carrier's neck comfortable feeling and releasing pressure. A lower rim of the auxiliary support cushion contacts with the carrier's lumbar to support the carrier's vertebra and lower a loading of the carrier's lumbar and vertebra.

However, the first fixing strap and the second fixing strap of the infant carrier are extended from the two sides of the neck support pad, gone under the armpit, and connected to about the middle section of the two sides of the front carrying bag. Putting the infant carrier on or off each time is not convenient for users. The tightened fixing straps also affect movement of users' arms and may lead to uncomfortable wearing experience. Thus there is room for improvement and there is a need to provide a baby carrier with novel design.

SUMMARY

Therefore, it is a primary object of the present invention to provide a baby carrier with easiness to put on and off, ergonomic design, and breathable and comfortable wearing experience.

In order to achieve the above object, a baby carrier according to the present invention includes a front carrier, a rear neck pad, and a spine support pad. The front carrier is worn in front of user's chest while the spine support pad is worn at user's back and extending upward from a height of user's lumbar spine. Two sides on a top of the front carrier are connected with a left shoulder strap and a right shoulder strap correspondingly. A rear end of the left shoulder strap and a rear end of the right shoulder strap are connected to an upper edge of the rear neck pad while a lower edge of the rear neck pad is provided with a vertical band whose length is adjustable and the vertical band is connected with an upper edge of the spine support pad. A lower edge of the front carrier at a height near user's waist is connected with a front waist strap. A left waist strap and a right waist strap are respectively extending horizontally from a left side and a right side of the front waist strap. The baby carrier features on that the spine support pad includes a support plate mounted therein and a piece of cloth covering the support plate. The support plate is made of hard material. The spine support pad is inverted T-shaped and further having a horizontal portion extending horizontally and a vertical portion extending upward from a middle of an upper edge of the horizontal portion along user's spine. A left side and a right side of the horizontal portion are extending to a left side and a right side of a back of user' waist. A plurality of pressure relief blocks is disposed on an inner surface of the spine support pad and in contact with the spine. A gap is provided between the two adjacent pressure relief blocks. A rear end of the left waist strap is connected to a first end of a left band while a second end of the left band is first inserted through a left ring on a left side of the spine support pad, folded over, and then connected to an upper edge of a left side of the front carrier. A rear end of the right waist strap is connected to a first end of a right band while a second end of the right band is first inserted through a right ring on a right side of the spine support pad, folded over, and connected to an upper edge of a right side of the front carrier. Thereby the front carrier, the left waist strap, the right waist strap, and the spine support pad are connected by the left band and the right band.

Preferably, the pressure relief block is formed by a cushioning material fixed on the support plate and the cloth covering the cushioning material. The cushioning material can be foam, viscose (artificial cotton), or natural cotton.

Preferably, a length of both the left band and the right band is adjustable. Both the left band and the right band are formed by two segments. The left band includes a left-band's first segment and a left-band's second segment. The first end of the left-band's first segment is fixed and connected to the rear end of the left waist strap while a free end of the left-band's first segment is first inserted through the left ring and folded over. The second end of the left-band's second segment is connected to the upper edge of the left side of the front carrier. The free end of the left-band's first segment and the other end of the left-band's second segment are connected by a quick connector. The free end of the left-band's first segment is slidably inserted through the quick connector so that a length between the first end of the left-band's first segment and the quick connector is able to be adjusted freely. The right band includes a right-band's first segment and a right-band's second segment. The first end of the right-band's first segment is fixed and connected to the rear end of the right waist strap while a free end of the right-band's first segment is first inserted through the right ring and folded over. The second end of the right-band's second segment is connected to the upper edge of the right side of the front carrier. The free end of the right-band's first segment and the other end of the right-band's second segment are connected by another quick connector. The free end of the right-band's first segment is slidably inserted through the quick connector so that a length between the first end of the right-band's first segment and the quick connector is able to be adjusted freely.

Preferably, a plurality of infrared ceramic pieces and/or magnets is arranged at an inner side of the cloth which is provided with a plurality of access gaps corresponding to the respective infrared ceramic pieces and/or the magnets.

Preferably, the infrared ceramic pieces and/or the magnets are mounted between the cloth and the cushioning material.

Preferably, the infrared ceramic pieces and the magnets are mounted between the cloth and the cushioning material. The present baby carrier features on that a lower edge of the spine support pad is abutting against user's lumbar spine for providing additional support to the user's spin. The design of the baby carrier is ergonomic and able to ease and distribute loads of the lumbar spine and the spine. The plurality of pressure relief blocks located on the inner surface of the spine support pad and in contact with the spine can allow air to flow for reduction of sultry feeling. Moreover, the first end of the left band and the first end of the right band are respectively connected to the rear end of the left waist strap and the rear end of the right waist strap. Then the second end of the left band and the second end of the right band are respectively inserted through the left ring and the right ring disposed on the spine support pad, folded over, and then connected to the upper edge of the left side and the upper edge of the right side of the front carrier. The user's left and right arms can move freely without being affected while wearing the present baby carrier. On the other hand, both the left band and the right band not only have two-segment design but also having an adjustable length. Thus the present baby carrier can be put on and off easily by users and providing users comfortable wearing experience.

The implementations, technical features, and functions of the present baby carrier are described in the following embodiments with reference to related figures.

DETAILED DESCRIPTION

In the following descriptions and figures of embodiments according to the present invention, directions mentioned (such as upper, lower, left, right, front and rear) are defined according to related figures and used for showing structure or relationship (such as positions, connections, and actions) among respective components. In principle, the directions described are proper when positions of the components or the structure mentioned in the specifications matches those in figures. Once the positions of the components or the structure mentioned in the specifications change, the directions described should have corresponding changes.

Figure 1:
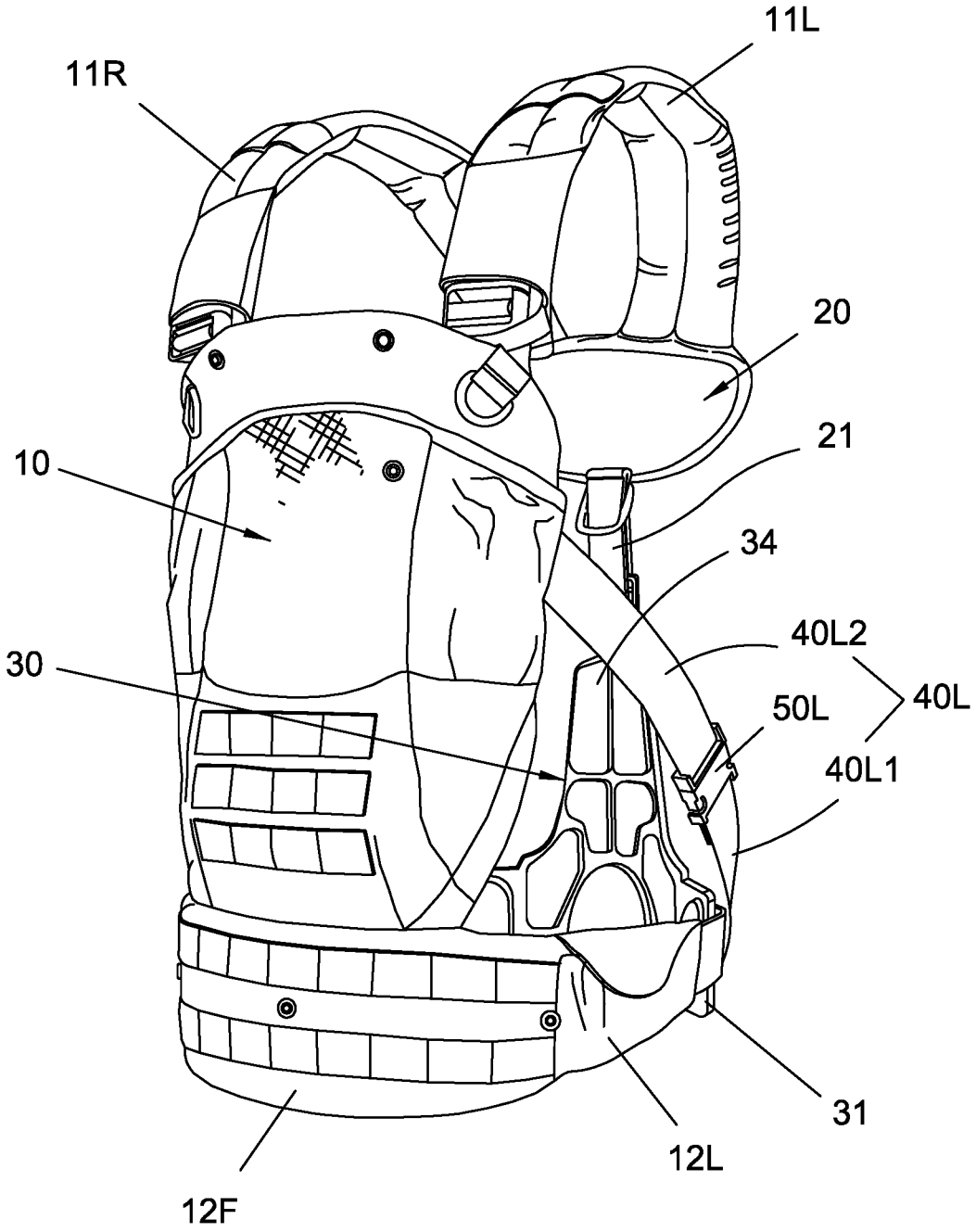
FIG. 1 is a perspective view of an embodiment of a baby carrier according to the present invention.
Figure 2:
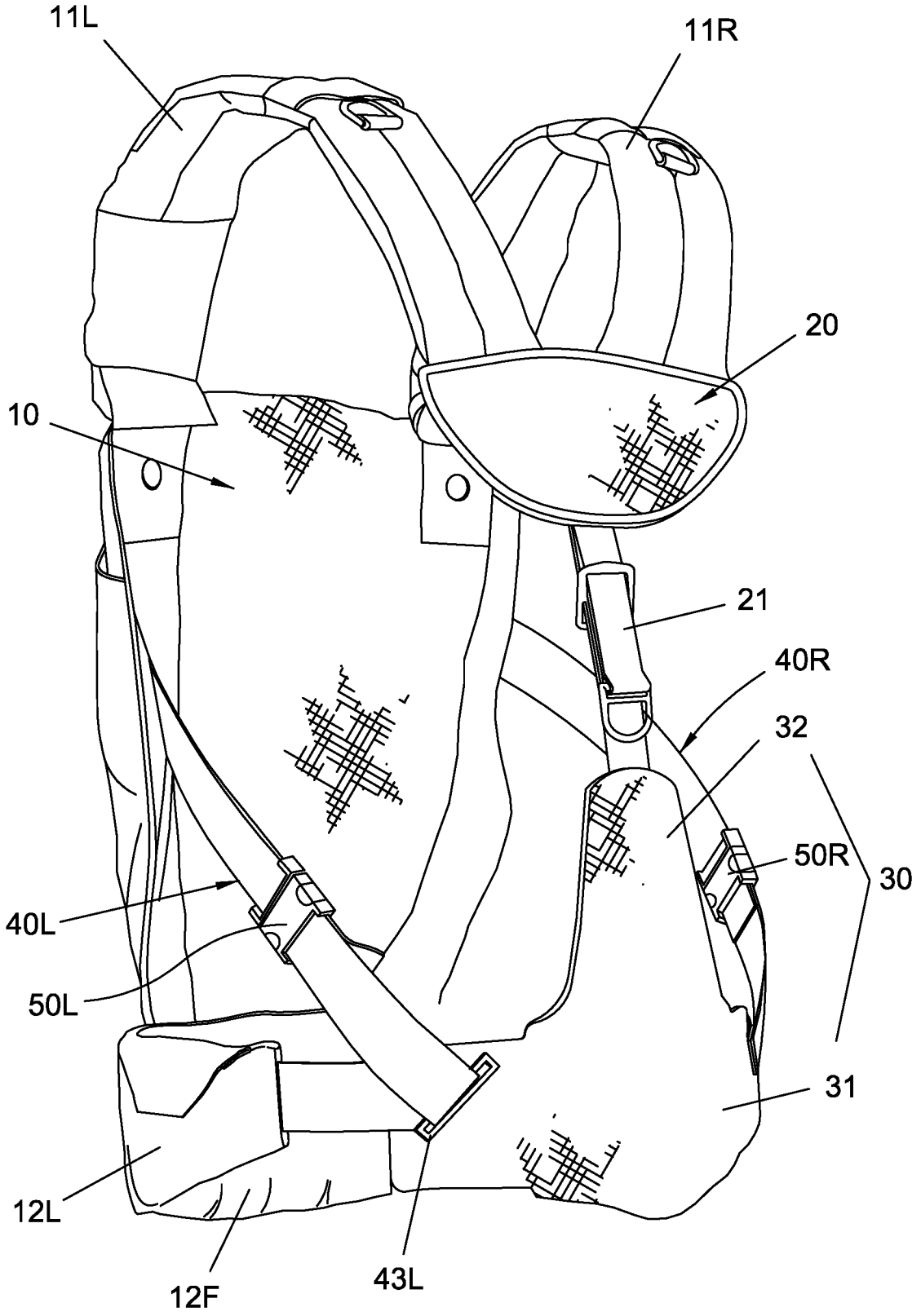
FIG. 2 is a left rear view of the embodiment in FIG. 1 according to the present invention.
Figure 3:
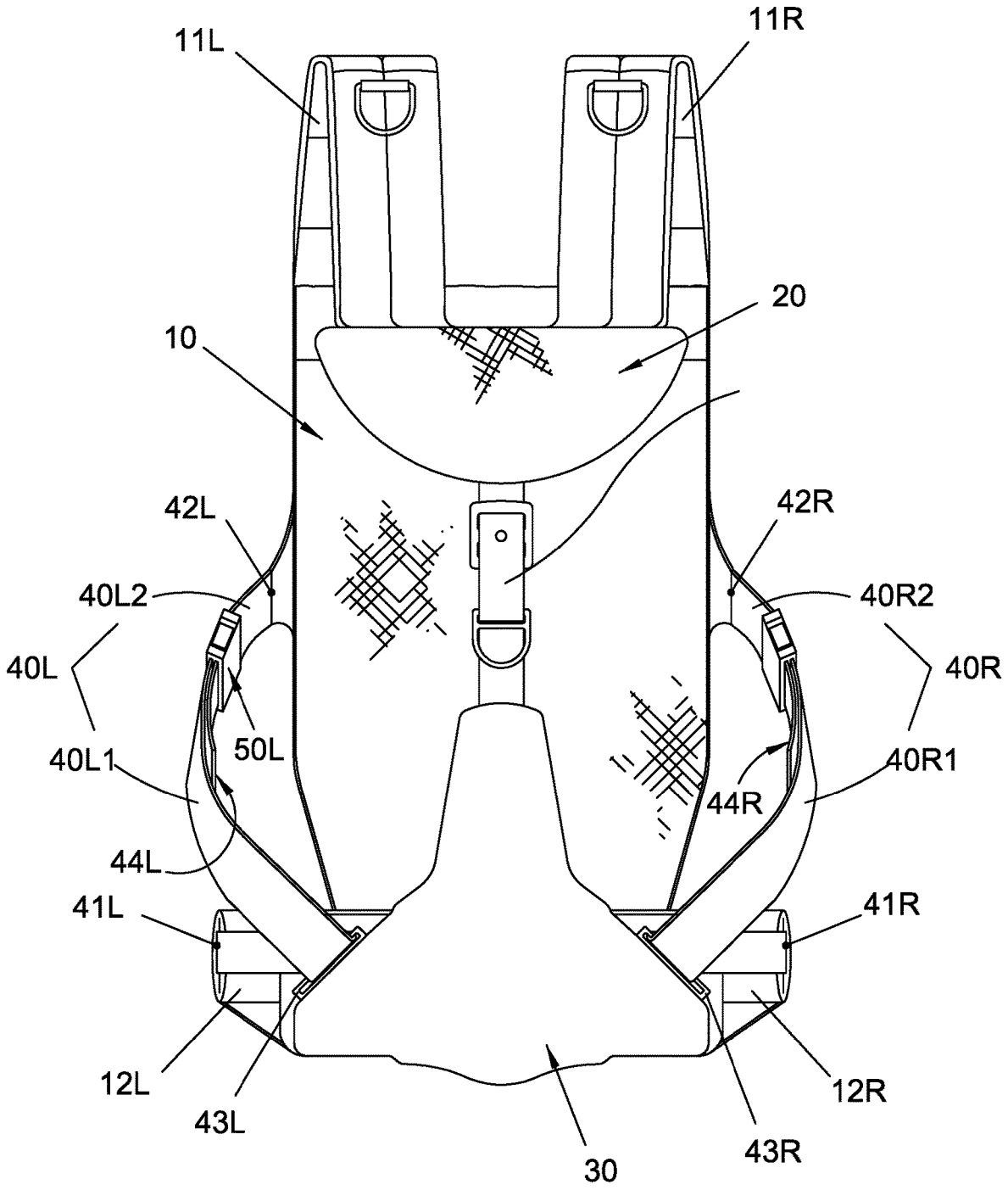
FIG. 3 is a rear view of the embodiment in FIG. 1 according to the present invention.

Refer to FIG. 1, FIG. 2, and FIG. 3, a baby carrier according to the present invention includes a front carrier 10, a rear neck pad 20, and a spine support pad 30.

The front carrier 10 is worn in front of user's chest for mounting a baby while the spine support pad 30 is worn at user's back and extending upward from a height of user's lumbar spine to reduce and distribute loads of lumbar spine and spine. A left shoulder strap 11L and a right shoulder strap 11R are connected to two sides on a top of the front carrier 10 correspondingly. A rear end of the left shoulder strap 11L and a rear end of the right shoulder strap 11R cross over user's shoulders to connect to an upper edge of the rear neck pad 20 located at a rear side of baby's neck. A lower edge of the rear neck pad 20 is provided with a vertical band 21 whose length is adjustable and the vertical band 21 is connected with an upper edge of the spine support pad 30. A lower edge of the front carrier 10 at a height near user's waist is connected with a front waist strap 12F. A left side and a right side of the front waist strap 12F are respectively provided with a left waist strap 12L and a right waist strap 12R which are extension parts respectively extending horizontally from the left side and the right side of the front waist strap 12F to a left side and a right side of the waist. A rear end of the left waist strap 12L and a rear end of the right waist strap 12R are connected to two sides of the spine support pad 30 at the height near the user's waist.

The present baby carrier particularly improves the spine support pad 30 and some bands therein for different purposes including easiness to put on and off, ergonomic design, breathable and comfortable wearing experience, etc. The preferred embodiments are described in detail below.

In a preferred embodiment, the spine support pad 30 is about inverted T-shaped and composed of a horizontal portion 31 extending horizontally and a vertical portion 32 extending upward from a middle of an upper edge of the horizontal portion 31 along a spine. A shape of the vertical portion 32 matches a curved shape of the spine and has ergonomic design. A left side and a right side of the horizontal portion 31 are extending to a left side and a right side of a back of the waist of human body. The spine support pad 30 further includes a support plate 33 made of hard material and mounted in the spine support pad 30, and a piece of cloth 35 covering the support plate 33.

Figure 4:
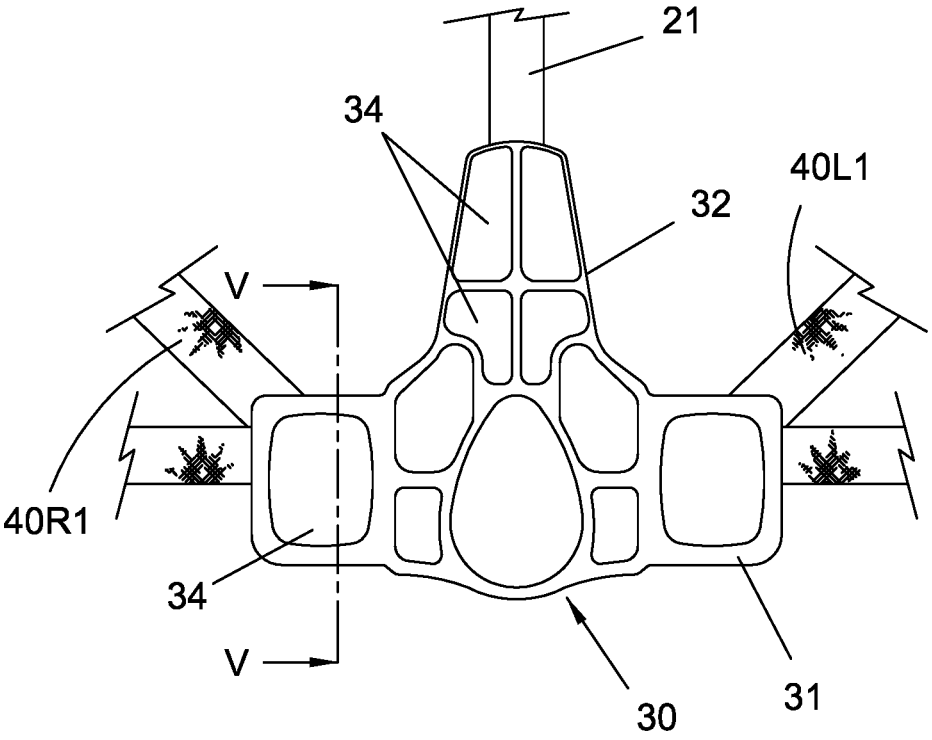
FIG. 4 is a partial enlarged view showing structure of an embodiment according to the present invention.
Figure 5:
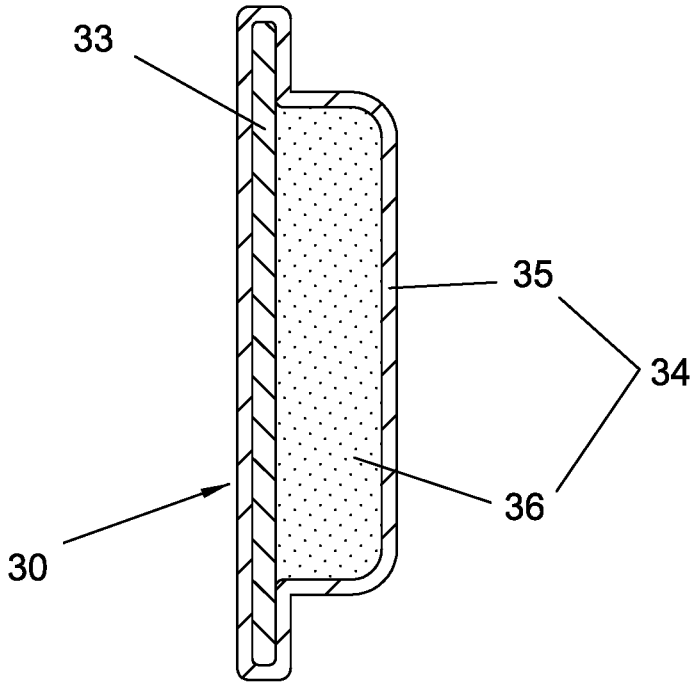
FIG. 5 is a sectional view along line V-V of the embodiment in FIG. 4 according to the present invention.
Figure 6:
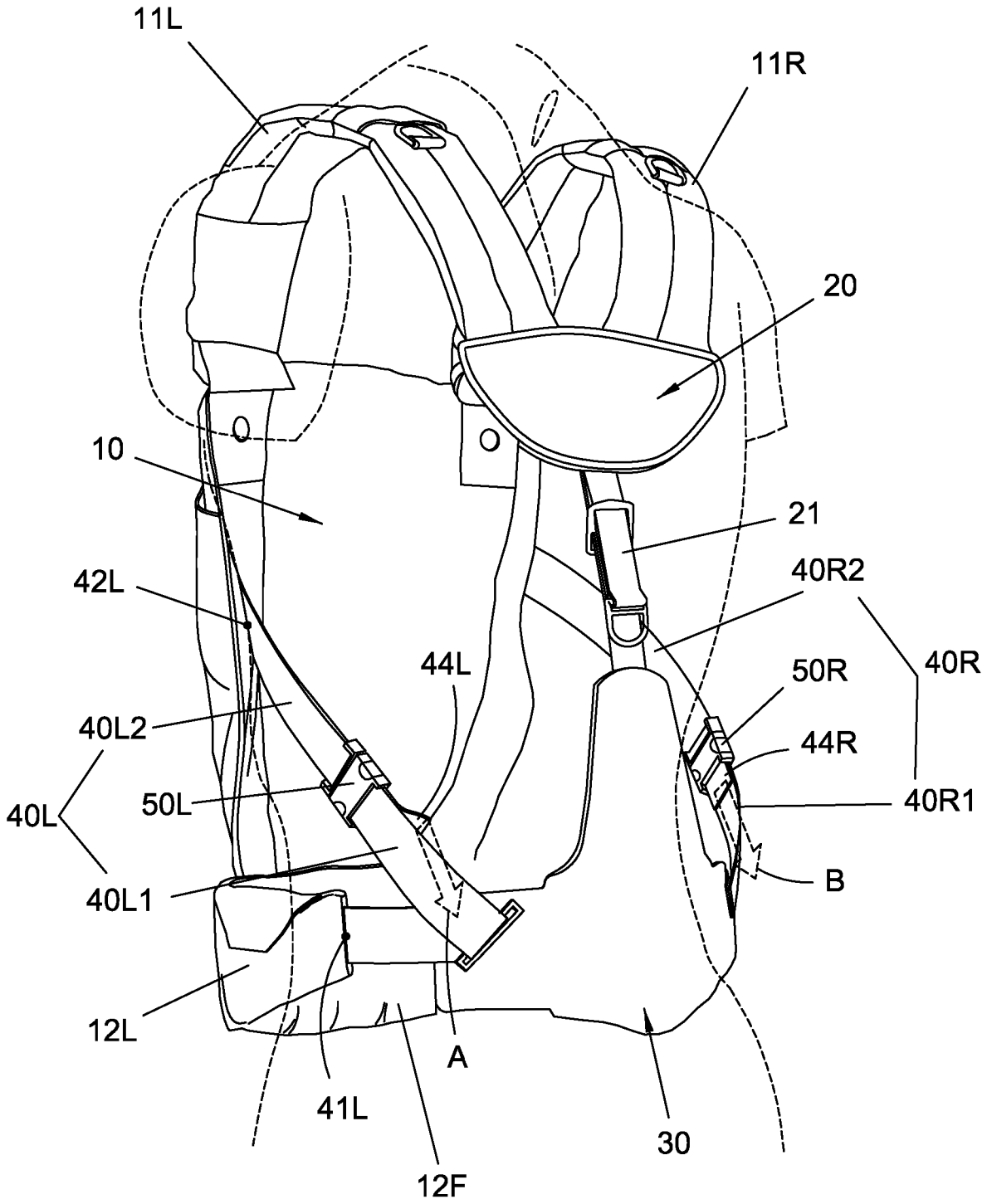
FIG. 6 is a schematic drawing showing an embodiment in use according to the present invention.

A plurality of pressure relief blocks is disposed on an inner surface of the spine support pad 30 and in contact with the spine. As shown in an embodiment of FIG. 4, a plurality of pressure relief blocks 34 projecting toward the spine is arranged at the right side and the left side of the spine symmetrically with the spine as a central line. In a preferred embodiment, the pressure relief blocks 34 are formed by a cushioning material 36 fixed on the support plate 33 and the cloth 35 covering the cushioning material 36 (as shown in FIG. 5). The cushioning material 36 can be foam, viscose (artificial cotton), or natural cotton. The cloth 35 can be nylon, waterproof breathable nylon, or other soft cloth (preferred with air permeability). A gap is provided between the two adjacent pressure relief blocks 34 for allowing air to flow to reduce sultry feeling. While carrying baby by using the present baby carrier (as shown in FIG. 6), a lower edge of the support plate 33 is abutting against the lumbar spine to provide the spine additional support. The above design is ergonomic and used to lighten and distribute loads of the lumbar spine and the spine.

Figure 7:
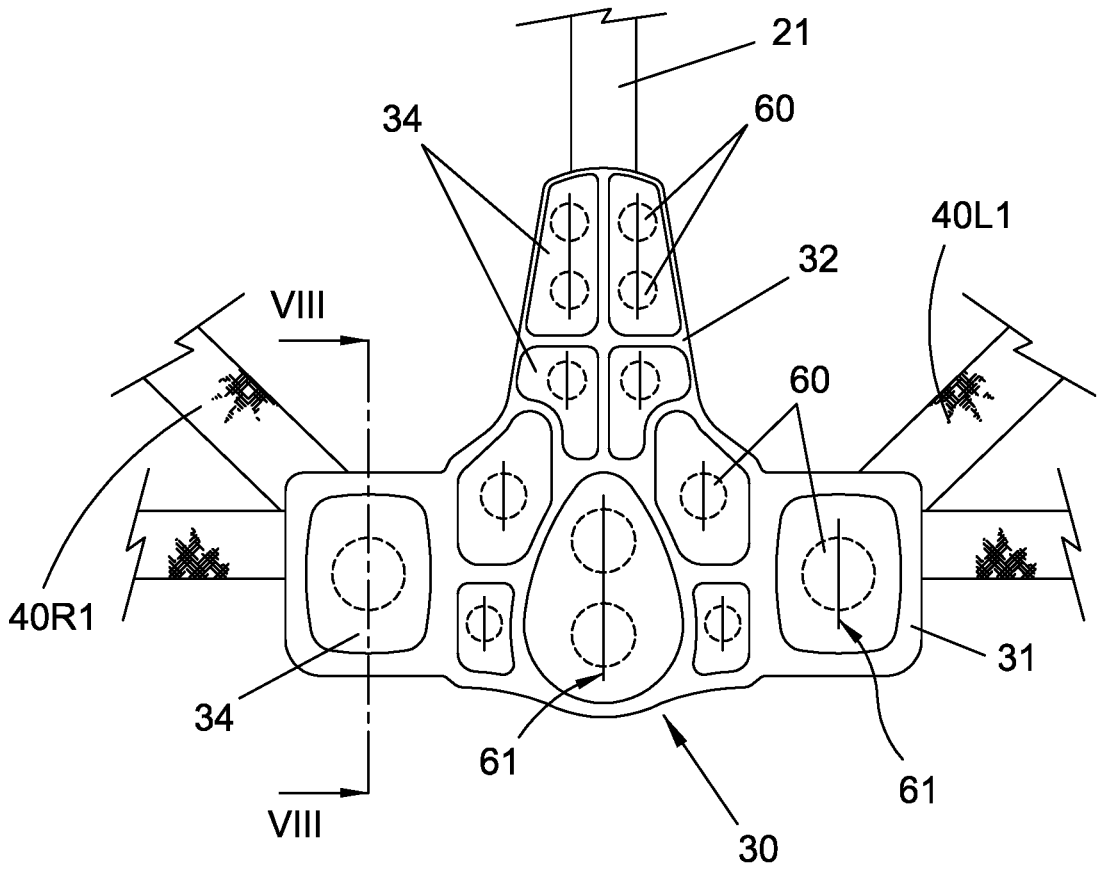
FIG. 7 is a schematic drawing showing structure of another embodiment of a spine support pad according to the present invention.
Figure 8:
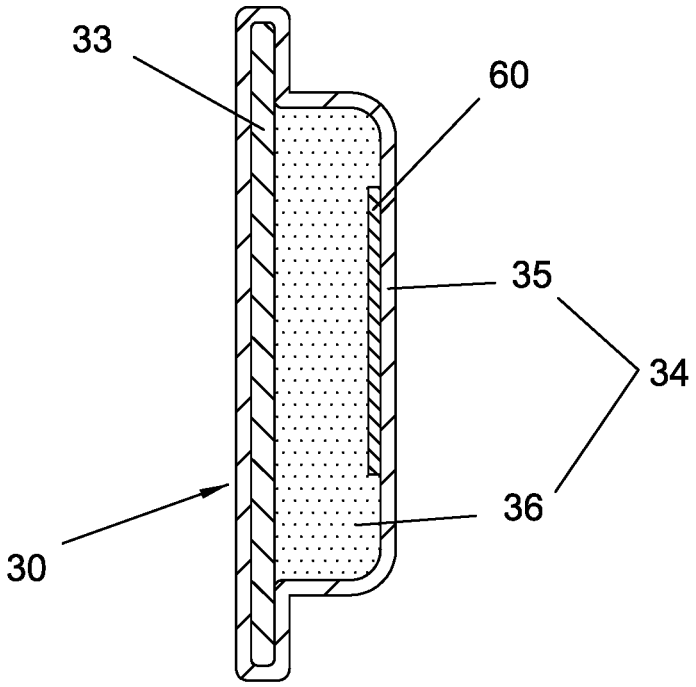
FIG. 8 is a sectional view along line VIII-VIII of the embodiment in FIG. 7 according to the present invention.

Refer to FIG. 7 and FIG. 8, another embodiment of a spine support pad 30 is provided. A plurality of infrared ceramic pieces 60 is arranged at an inner side of the cloth 35. A plurality of access gaps 61 corresponding to the infrared ceramic pieces 60 is formed on the cloth 35 so that users can take the infrared ceramic piece 60 out or put the infrared ceramic pieces 60 in through the access gap 61. In a preferred embodiment, the access gap 61 is a gap formed by sewing buttonholes on the cloth 35. In another preferred embodiment, the access gap 61 is formed in a way of sewing a zipper on the clothes in a concealed way. A flap of fabric is arranged at one side of the access gap 61 to cover the access gap 61 and make the access gap 61 invisible (achieve a hidden look) for aesthetic purposes. In a further preferred embodiment, the infrared ceramic pieces 60 are replaced by magnets or both a plurality of infrared ceramic pieces 60 and magnets are placed on an inner side of the cloth 35 in a staggered manner. The above infrared ceramic pieces 60 and magnets are placed between the cloth 35 and the cushioning material 36. Thus far infrared radiation released from the infrared ceramic pieces 60 and magnetic lines of force around the magnets help maintain good health by acceleration of blood circulation, elimination of fatigue, and activation of cells.

Refer to FIG. 3, for easiness to put on and off and comfortable wearing experience, the left waist strap 12L and the right waist strap 12R are respectively connected with the left side and the right side of the spine support pad 30 by a left band 40L and a right band 40R. A first end 41L of the left band 40L is fixed and connected to the rear end of the left waist strap 12L while a second end 42L of the left band 40L is first inserted through a left ring 43L on the left side of the spine support pad 30, folded over, and connected with an upper edge of a left side of the front carrier 10. A first end 41R of the right band 40R is fixed and connected to the rear end of the right waist strap 12R while a second end 42R of the right band 40R is first inserted through a right ring 43R on the right side of the spine support pad 30, folded over, and connected with an upper edge of a right side of the front carrier 10. The front carrier 10, the left waist strap 12L, the right waist strap 12R, and the spine support pad 30 are connected by the left band 40L and the right band 40R. Thereby present baby carrier can be worn securely on user's body.

In a preferred embodiment, a length of both the left band 40L and the right band 40R is adjustable so that users can adjust and wear the baby carrier comfortably according to their figures. In a preferred embodiment, both the left band 40L and the right band 40R are formed by two segments. As shown in FIG. 3, the left band 40L includes a left-band's first segment 40L1 and a left-band's second segment 40L2. The first end 41L of the left-band's first segment 40L1 is fixed and connected to the rear end of the left waist strap 12L while a free end 44L of the left-band's first segment 40L1 is first inserted through the left ring 43L on the left side of the spine support pad 30 and folded over. The second end 42L of the left-band's second segment 40L2 is connected to the upper edge of the left side of the front carrier 10. The free end 44L of the left-band's first segment 40L1 and the other end of the left-band's second segment 40L2 are connected by a quick connector 50L. The free end 44L of the left-band's first segment 40L1 is slidably inserted through the quick connector 50L. Thus users can tighten the free end 44L (as an arrow A in FIG. 6 indicates) or loose the free end 44L to adjust a length between the first end 41L of the left-band's first segment 40L1 and the quick connector 50L.

The right band 40R includes a right-band's first segment 40R1 and a right-band's second segment 40R2. The first end 41R of the right-band's first segment 40R1 is fixed and connected to the rear end of the right waist strap 12R while a free end 44R of the right-band's first segment 40R1 is first inserted through the right ring 43R on the right side of the spine support pad 30 and folded over. The second end 42R of the right-band's second segment 40R2 is connected with the upper edge of the right side of the front carrier 10. The free end 44R of the right-band's first segment 40R1 and the other end of the right-band's second segment 40R2 are connected by a quick connector 50R. The free end 44R of the right-band's first segment 40R1 is slidably inserted through the quick connector 50R. Thus users can tighten the free end 44R (as an arrow B in FIG. 6 indicates) or loose the free end 44R to adjust a length between the first end 41R of the right-band's first segment 40R1 and the quick connector 50R.

After user's head being inserted through a hole formed among the left shoulder strap 11L, the right shoulder strap 11R, and the spine support pad 30 (refer to FIG. 6), connect the left-band's first segment 40L1 and the left-band's second segment 40L2 by the quick connector 50L. Then connect the right-band's first segment 40R1 and the right-band's second segment 40R2 by the quick connector 50R. Then adjust a length of both the left-band's first segment 40L1 and the right-band's first segment 40R1 easily. Thus wearing of the present baby carrier is completed and the left band 40L and the right band 40R are respectively extending downward slantingly from the left side and the right side of user's front chest toward the left side and the right side of the back of the waist. The user's left and right arms can move freely without being affected by the baby carrier. In contrast, the present baby carrier can be put off easily by unlocking the quick connector 50L and the quick connector 50R.

In a preferred embodiment, the front carrier 10 and the rear neck pad 20 are soft components with cushioning capacity and formed by a piece of cloth with at least one interval and cushioning material mounted in the interval. The cloth can be nylon, waterproof breathable nylon, or other soft cloth, which is sewn to form double-layer or multiple-layer structure with the interval between the two adjacent layers. Then cushioning materials such as foam, viscose (artificial cotton), or natural cotton are mounted into the interval for providing breathable, soft, and comfortable wearing experience.

The rear neck pad 20 provides user's rear neck more comfortable feeling and pressure relief. For users with different heights, the rear neck pad 20 can even be adjusted to the position between left and right shoulder blades (as shown in FIG. 6) by adjustment of the length of the vertical band 21 for relieving fatigue and pressure of the back. The lower edge of the spine support pad 30 is abutting against the lumbar spine to provide additional support to the spine. The above design of the spine support pad 30 is ergonomic and able to reduce and distribute loads of the lumbar spine and the spine. According to the figures of respective users, the spine support pad 30 can be adjusted to match the user's spine for allowing the user to have the most comfortable feeling.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

The invention claimed is:

1. A baby carrier comprising a front carrier, a rear neck pad, and a spine support pad;

wherein the front carrier is worn in front of a chest while the spine support pad is worn at a back and extending upward from a height of a lumbar spine; a left shoulder strap and a right shoulder strap are connected to two sides on a top of the front carrier correspondingly; a rear end of the left shoulder strap and a rear end of the right shoulder strap are connected to an upper edge of the rear neck pad while a lower edge of the rear neck pad is provided with a vertical band whose length is adjustable and the vertical band is connected with an upper edge of the spine support pad; a lower edge of the front carrier at a height near a waist is connected with a front waist strap; a left side and a right side of the front waist strap are respectively provided with a left waist strap and a right waist strap, both extending horizontally;

wherein the spine support pad includes a support plate mounted in the spine support pad and a piece of cloth covering the support plate; the support plate is made of hard material; the spine support pad is inverted T-shaped and further having a horizontal portion extending horizontally and a vertical portion extending upward from a middle of an upper edge of the horizontal portion along a spine; a left side and a right side of the horizontal portion are extending to a left side and a right side of a back of the waist; a plurality of pressure relief blocks is disposed on an inner surface of the spine support pad and in contact with the spine while a gap is provided between two adjacent pressure relief blocks;

wherein a rear end of the left waist strap is connected to a first end of a left band while a second end of the left band is first inserted through a left ring on a left side of the spine support pad, folded over, and connected to an upper edge of a left side of the front carrier; a rear end of the right waist strap is connected to a first end of a right band while a second end of the right band is first inserted through a right ring on a right side of the spine support pad, folded over, and connected to an upper edge of a right side of the front carrier; wherein the front carrier, the left waist strap, the right waist strap, and the spine support pad are connected by the left band and the right band.

2. The baby carrier as claimed in claim 1, wherein the pressure relief blocks are formed by one cushioning material fixed on the support plate and the cloth covering the cushioning material; the cushioning material is selected from the group consisting of foam, artificial cotton, and natural cotton.

3. The baby carrier as claimed in claim 1, wherein a length of the left band and a length of the right band are adjustable; both the left band and the right band are formed by two segments; the left band includes a left-band's first segment and a left-band's second segment; the first end of the left-band's first segment is fixed and connected to the rear end of the left waist strap while a free end of the left-band's first segment is first inserted through the left ring and folded over; the second end of the left-band's second segment is connected to the upper edge of the left side of the front carrier; the free end of the left-band's first segment and the other end of the left-band's second segment are connected by a quick connector; the free end of the left-band's first segment is slidably inserted through the quick connector so that a length between the first end of the left-band's first segment and the quick connector is able to be adjusted freely;

wherein the right band includes a right-band's first segment and a right-band's second segment; the first end of the right-band's first segment is fixed and connected to the rear end of the right waist strap while a free end of the right-band's first segment is first inserted through the right ring and folded over; the second end of the right-band's second segment is connected with the upper edge of the right side of the front carrier; the free end of the right-band's first segment and the other end of the right-band's second segment are connected by a quick connector; the free end of the right-band's first segment is slidably inserted through the quick connector so that a length between the first end of the right-band's first segment and the quick connector is able to be adjusted freely.

4. The baby carrier as claimed in claim 2, wherein a plurality of infrared ceramic pieces is arranged at an inner side of the cloth; the cloth is provided with a plurality of access gaps corresponding to the infrared ceramic pieces.

5. The baby carrier as claimed in claim 4, wherein the infrared ceramic pieces are mounted between the cloth and the cushioning material.

6. The baby carrier as claimed in claim 2, wherein a plurality of magnets is arranged at an inner side of the cloth; the cloth is provided with a plurality of access gaps corresponding to the magnets.

7. The baby carrier as claimed in claim 6, wherein the magnets are mounted between the cloth and the cushioning material.

* * * * *